United States Patent [19]

Day

[11] 4,177,059

[45] Dec. 4, 1979

[54] PRODUCTION OF YTTRIUM

[75] Inventor: Joseph G. Day, Holmer Green, England

[73] Assignee: Johnson, Matthey & Co., Limited, London, England

[21] Appl. No.: 922,194

[22] Filed: Jul. 5, 1978

[30] Foreign Application Priority Data

Jul. 5, 1977 [GB] United Kingdom ..... 28072/77

[51] Int. Cl.[2] ..... C22B 4/04

[52] U.S. Cl. ..... 75/10 R; 75/84

[58] Field of Search ..... 75/10 R, 84

[56] References Cited

U.S. PATENT DOCUMENTS

| | | | |
|---|---|---|---|
| 3,009,807 | 11/1961 | Dennison | 75/84 |
| 3,150,964 | 9/1964 | Carlson | 75/84 |
| 3,264,093 | 8/1966 | Sump | 75/10 R |
| 3,873,307 | 3/1975 | Morrice | 75/84 |
| 3,953,579 | 4/1976 | Herchenroeder | 75/10 R |
| 3,980,468 | 9/1976 | Rosof | 75/10 R |

*Primary Examiner*—P. D. Rosenberg

*Attorney, Agent, or Firm*—Cushman, Darby & Cushman

[57] ABSTRACT

This invention relates to refining yttrium. Known methods of refining yttrium involve the use of expensive crucibles made from tantalum or tungsten which are only available in relatively small sizes. According to the present invention there is provided a process for the production of yttrium metal and alloys thereof in which calcium (metal) and yttrium fluoride are reacted together by use of a submerged electric arc in a molten slag.

6 Claims, No Drawings

PRODUCTION OF YTTRIUM

This invention relates to improved methods for the refining of yttrium; more particularly it relates to improved methods for the production of pure yttrium metal and alloys thereof.

Known methods for the production of yttrium involve the use of tungsten or tantalum crucibles. Such crucibles are relatively expensive and are only available in quite small sizes, e.g. 6 inches by 10–12 inches long.

It is one object of the present invention to produce yttrium and alloys thereof in reasonable quantity, e.g. in batches of 20 Kg. or more.

According to one aspect of the present invention a process for the production of yttrium or of an alloy comprising a major proportion of yttrium comprises reacting together calcium (metal) and yttrium fluoride ($YF_3$) by the use of a submerged electric arc.

The electric arc is carried through a molten slag to which the reactants are added. Suitably the major slag component is calcium fluoride, optionally in combination with other fluorides, such as magnesium and/or barium fluoride.

Preferably the reactants are contained in a large water-cooled copper or iron crucible having a lining of calcium fluoride ($CaF_2$) covering the walls. Calcium fluoride is also present as the slag material and at the temperature of operation has conductivity sufficient to conduct the current between the electrodes. A suitable temperature is about 1500° C.

The reactants may be added in the form of powder or granules. When the reaction has taken place, the resulting metal forms a layer below the molten slag and may be allowed to solidify on a cooled base plate or in a mould situated at the bottom of the crucible or may be run off as liquid metal.

The submerged arc may pass between an electrode and a base plate or between two electrodes. In one embodiment of the invention the submerged arc is formed between tungsten or carbon electrodes. In another embodiment of the invention, which is preferred under some circumstances, consumable electrodes made of iron are used. Such electrodes are preferred when instead of being operated for the production of pure yttrium, the invention is operated for the production of useful alloys of yttrium and iron.

In the latter case as well as being present in the form of a consumable electrode iron may also be added to the crucible either before commencement or during the reduction reaction. Iron is preferably added as ferric fluoride $FeF_3$ but may be added as iron filings and is present to the extent sufficient to give a master alloy composition of Fe, 25% by weight Y, 75% by weight. This is a useful eutectic having a melting point of about 900° C., but by adjustment of the proportion of iron added, other alloy compositions may be made.

According to a second aspect of the present invention, therefore, the process is carried out in the presence of iron or iron fluoride. Preferably the submerged arc is then formed between consumable iron electrodes.

In another embodiment of the invention the reactants are introduced by way of a consumable electrode consisting of an iron tube containing the desired proportion of yttrium fluoride and calcium.

Other useful alloys of yttrium which may be produced by a process according to the present invention are alloys of yttrium and aluminium. The use of such alloys is disclosed in our co-pending application No. 28073/77 on the subject of the manufacture of yttrium containing alloys, particularly Fe-Cr-Al-Y alloys for nuclear reactors and catalyst substrates.

According to a third aspect of the present invention, therefore, the process is carried out in the presence of aluminium or aluminium fluoride. In this case it is preferred to use tungsten or carbon electrodes. A suitable Al-Y eutectic which may be made by this technique is one containing Al 10% by weight, Y 90% by weight. Other ratios may be produced, however. If the presence of iron is required in the final alloy, consumable iron electrodes may be used and iron or ferric fluoride may be added to the Ca-$YF_3$ reaction mixture.

EXAMPLE 1

A water-cooled iron crucible, into which two carbon electrodes project, was loaded with calcium fluoride granules and an electric current was passed between the electrodes. The current melted the granules and raised the temperature of the melt to about 1500° C. A layer of solid calcium fluoride formed on the crucible walls and provided a lining. Calcium (metal) and yttrium fluoride granules were then added in a proportion of 5:12 by weight. Yttrium metal resulted from the reaction of these two components and formed a liquid layer beneath the molten slag. The metal was run off through a tapping hole which, during the reaction period, was sealed by a water-cooled plug.

EXAMPLE 2

The process of Example 1 was repeated but in a water-cooled crucible having a separate water-cooled base. Only one electrode was used and the arc was struck between this electrode and the base plate. The yttrium metal formed during the reaction solidified on the base plate and at the end of the reaction was extracted from the crucible by removal of the base plate.

EXAMPLE 3

The process of Example 1 was repeated using iron electrodes to carry the arc. Iron filings were added with the reactants to produce an alloy of yttrium and iron containing 25% by weight of iron. This was run off and cast under a protective atmosphere.

EXAMPLE 4

The process of Example 1 was repeated but before the reactants were added, a proportion of iron was pre-melted in the crucible. When the reactants were added, the resultant yttrium flowed down into the layer of molten iron to form an alloy containing about 25% by weight of iron which was run off and cast.

What we claim is:

1. A process for the production of yttrium metal and alloys thereof in which calcium metal and yttrium fluoride are reacted together by the use of electric resistance heating in a molten slag which contains the calcium metal, the yttrium fluoride and a preponderant amount of calcium fluoride.

2. A process as claimed in claim 1 or 2 carried out in a crucible lined with calcium fluoride.

3. A process as claimed in claim 1, 2 in which the arc is passed between tungsten or carbon electrodes.

4. A process as claimed in claims 1, or 2 in which iron is added to the molten slag.

5. A process as claimed in claim 1, 2 in which iron is added by way of consumable iron electrodes.

6. A process as claimed in claim 5 in which the consumable electrode is an iron tube containing calcium (metal) and yttrium fluoride.

* * * * *